United States Patent [19]

Lucke

[11] 4,173,311

[45] Nov. 6, 1979

[54] DEVICE FOR CUTTING YARN ON BALL WINDING MACHINES

[75] Inventor: Florian Lucke, Mengen, Fed. Rep. of Germany

[73] Assignee: Lucke Apparatebau GmbH, Fed. Rep. of Germany

[21] Appl. No.: 907,892

[22] Filed: May 19, 1978

[30] Foreign Application Priority Data

Jun. 2, 1977 [DE] Fed. Rep. of Germany ..... 2724892

[51] Int. Cl.[2] ..... B65H 54/66; B26D 5/08

[52] U.S. Cl. ..... 242/2; 83/623; 83/909

[58] Field of Search ..... 242/2, 3, 7.05 B, 53; 83/69, 153, 623, 909

[56] References Cited

U.S. PATENT DOCUMENTS 3,762,661 10/1973 Lucke ..... 242/53
3,927,469 12/1975 Dammar ..... 242/7.05 B X

FOREIGN PATENT DOCUMENTS 1060881 3/1967 United Kingdom ..... 242/2

*Primary Examiner*—Billy S. Taylor

*Attorney, Agent, or Firm*—Leydig, Voit, Osann, Mayer & Halt Ltd.

[57] ABSTRACT

A cutting device at each winding station of a ball winding machine comprises two thread clamps located between the winding mandrel and the winding flyer at that station, which clamps are spaced apart and clamp the yarn and then carry the clamped yarn to a cutting element which severs the yarn between the clamps.

6 Claims, 5 Drawing Figures

DEVICE FOR CUTTING YARN ON BALL WINDING MACHINES

BACKGROUND OF THE INVENTION

This invention relates to a device for cutting yarn on a ball winding machine having, at each winding station a winding flyer, a winding mandrel and a cutting element.

In known devices for cutting yarn, the yarn is usually severed in its path between a thread guide element and a fully wound ball. Two free ends remain, one of which is the "start" of the ball when it is processed and the other is the end of the piece of yarn which has to be attached to the winding mandrel at the beginning of a fresh winding operation. It has been found that the free yarn ends are not always simple to manage during the automatic winding of balls, so that when banding or removing the ball from its winding mandrel a free yarn end remains hanging down from a ball, and/or the free end of the yarn to be wound is difficult to feed to the winding mandrel.

A main object of the invention is to overcome this disadvantage by providing a cutting device which ensures reliable handling of both the yarn ends produced by cutting, both when banding and removing the finished ball, and at the commencement of winding of a fresh ball.

SUMMARY OF THE INVENTION

This object is achieved by associating with the cutting device at each winding station two movably mounted thread clamps each of which clamps firmly the thread travelling from the winding flyer to the winding mandrel in two separate places, and mounting means for the thread clamps operable to feed the clamped yarn to the cutting device in such a way that it is severed between the clamps so that the cut ends are held in the clamps.

BRIEF DESCRIPTION OF THE DRAWINGS

A preferred embodiment of the invention will now be described, by way of example, with reference to the accompanying drawings in which.

DESCRIPTION OF THE PREFERRED EMBODIMENTS

Figure 1:
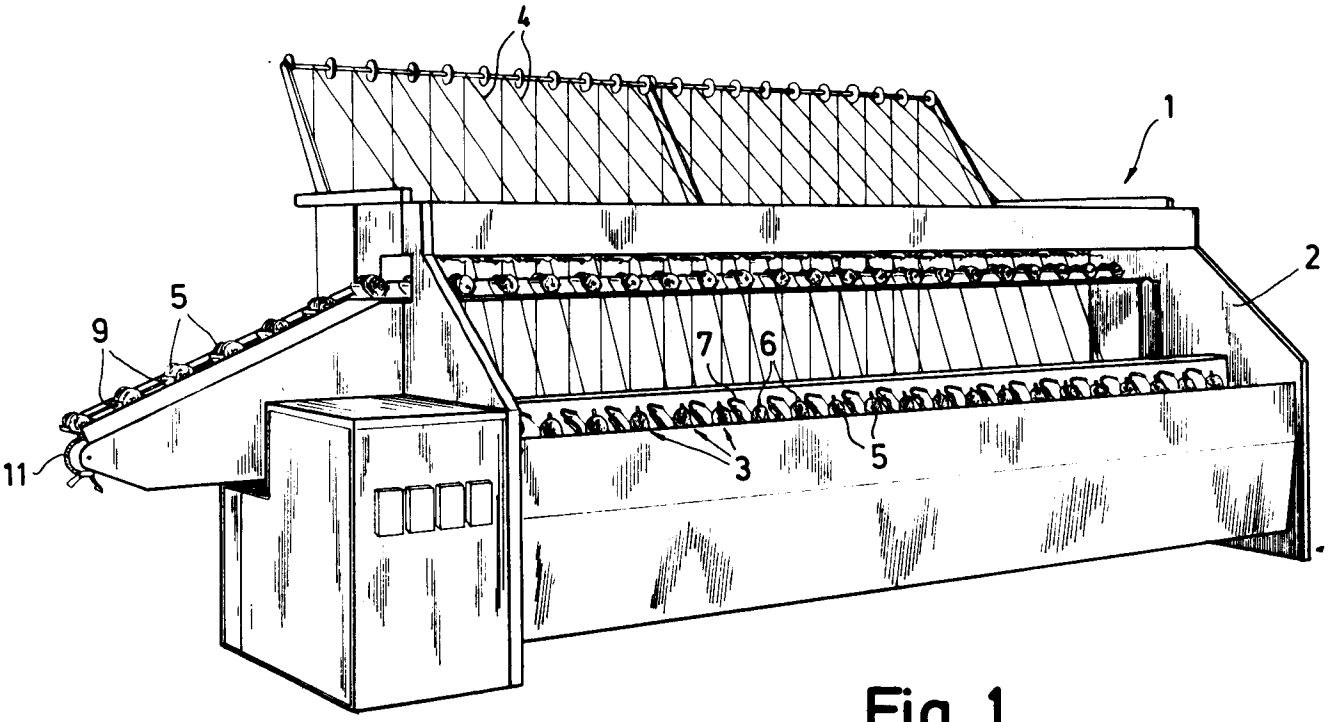
FIG. 1 is a simplified general view of a ball winding machine with a plurality of winding stations.

FIG. 1 shows a ball winding machine 1, known per se, which has on a machine frame 2 in a horizontal row, a plurality, e.g. twenty, winding stations 3. At each winding station 3, a yarn ball 5 is wound from yarn 4, and the yarns pass from supply reels, not shown, in FIG. 1, arranged behind the machine.

Figure 2:
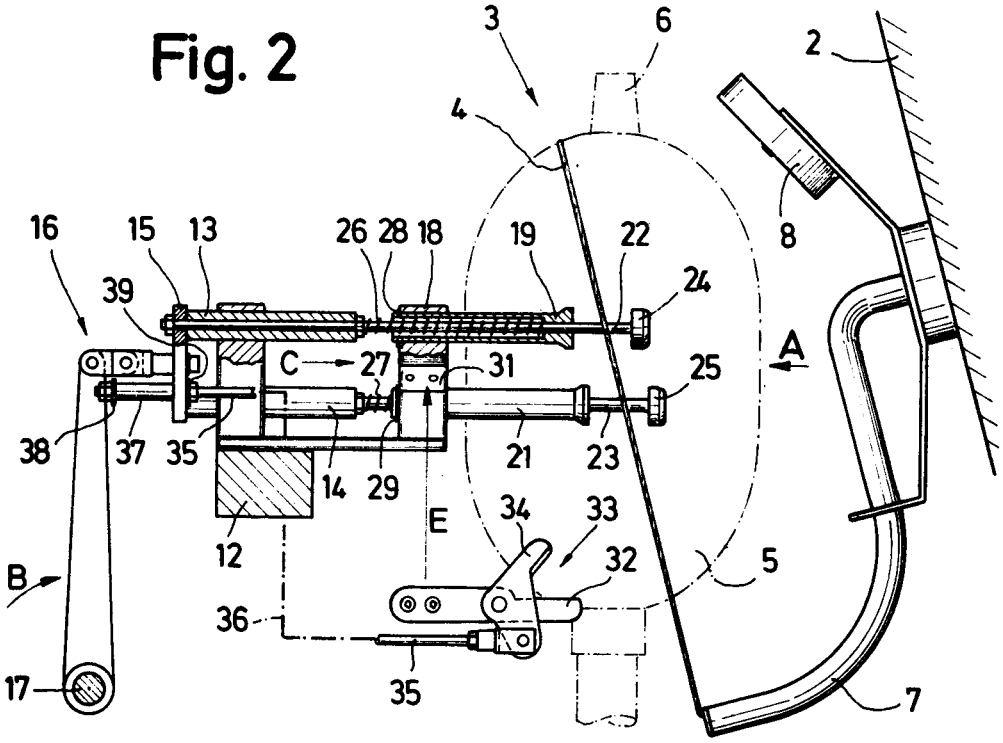
FIG. 2 is a side elevation of one of the winding stations of the machine of FIG. 1 with a yarn cutting device.
Figure 3:
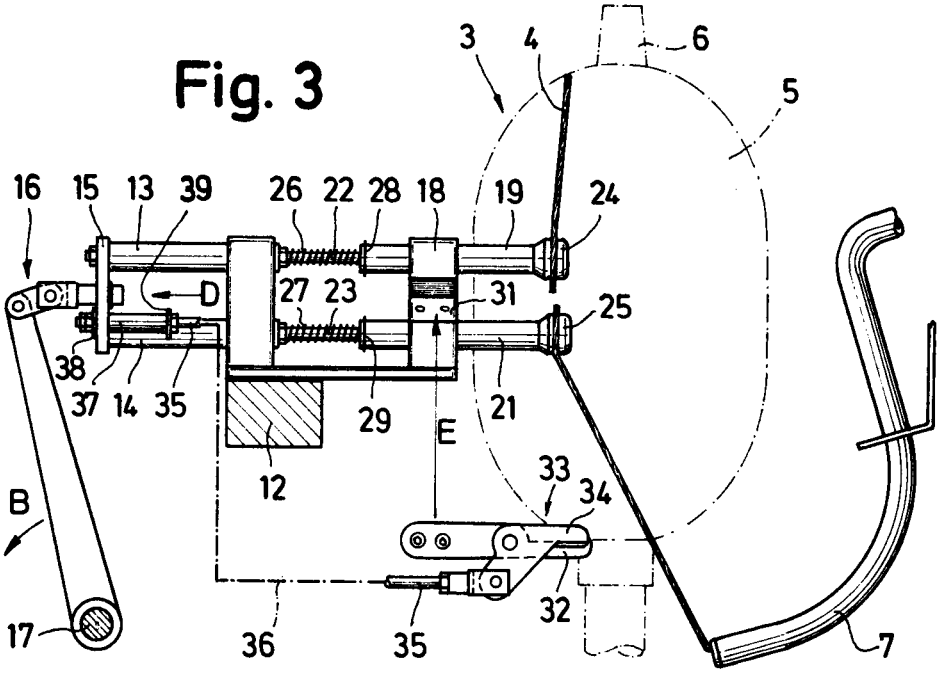
FIG. 3 shows the winding station of FIG. 2 in another service position of the cutting device.
Figure 4:
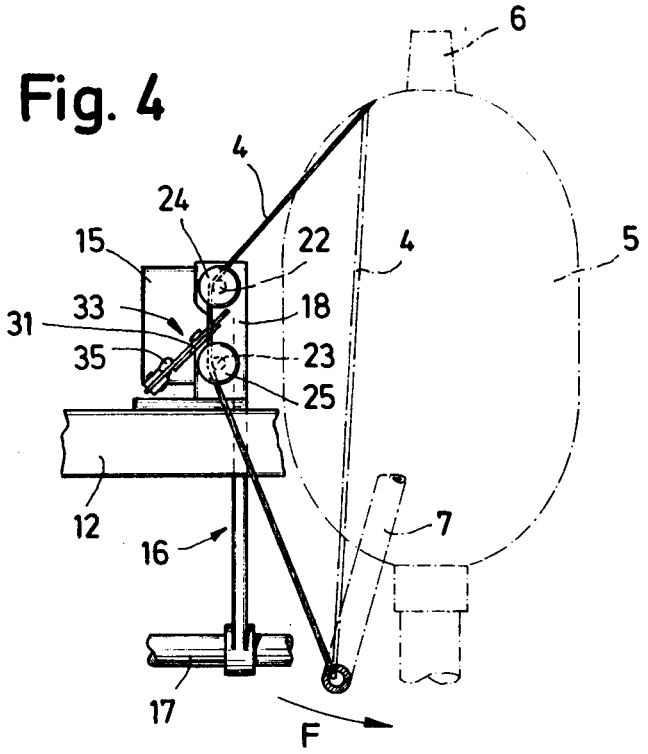
FIG. 4 is an elevation of the winding station in the direction of the arrow A in FIG, 2.

FIGS. 2, 3 and 4 are views of one winding station 3. Each such station comprises a winding mandrel 6 which is rotatably driven in known manner, and on to which a ball 5 is wound. The yarn 4 is fed by a winding flyer 7, known per se, constituted by a crank-shaped curved tube which is mounted rotatably on the machine frame 2 and is motor driven. A weight 8 serves to balance the winding flyer 7. The yarn 4 fed from one of the supply reels exits from the free end of the winding flyer 7 towards the winding mandrel 6 and there forms, with simultaneous rotation of the mandrel 6 and the flyer 7, a ball 5 in the known crosswise winding. After the severing of the fed yarn, described below, the finished balls 5 are transferred by gripper and transfer devices, not shown, into cups 9 of an endless conveyor 11 by which they are transported laterally out of the machine, towards the left hand side as shown in FIG. 1. Before the balls 5 are transferred from the winding stations 3 into the cups 9 they may be provided with a band in conventional manner.

FIGS. 2 and 3 show a cutting device for the yarn 4 comprising a stationary guide means 12 in which two guide sleeves 13 and 14 are slidably mounted one above the other. The sleeves 13 and 14 are attached at their rear ends to a pressure plate 15 which is connected to a multi-element linkage 16, known per se, which is pivoted and reciprocates in the direction of the arrow B. The linkage 16 is rocked by a rocker shaft 17 which is driven by a motor, not shown, so that the guide sleeves 13 and 14 reciprocate in the direction of the arrows C and D by sliding in the guide means 12.

In a further guide means 18, which is attached to the machine frame 2 and like the guide means 12 is stationary, two clamp sleeves 19 and 21 are slidable one above the other and are aligned axially with the guide sleeves 13 and 14. Guide rods 22 and 23 which are attached firmly to the guide sleeves 13 and 14 slide in the clamp sleeves 19 and 21 and carry clamp heads 24 and 25 at their ends. Helical compression springs 26 and 27 engage at one end against the front of the guide sleeves 13 and 14 and at the other end against support surfaces located in the interiors of the clamp sleeves 19 and 21 so that they tend to slide forwardly in the sleeves 19 and 21 as far as possible relative to the sleeves 13 and 14 until stops 28 and 29 on the clamp sleeves 19 and 21 abut against the guide means 18, thereby determining the extreme front limit position of the clamp sleeves 19 and 21. The front ends of the clamp sleeves 19 and 21 are widened so that the free end faces of the sleeves have approximately the same diameter as the rear end faces of the clamp heads 24 and 25.

The cutting device is a shears 33 one blade 32 of which is fixed by means of two screws not shown, to an oblique surface, indicated at 31 in FIGS. 2 and 3, of the guide means 18. For greater clarity in FIGS. 2 and 3, the shears 33 is shown detached from the oblique surface 31. The arrow E indicates the fixture to said surface.

A second blade 34 of the shears 33 is of angular construction and is pivotally mounted on the blade 32. An actuating rod 35 is articulated to the blade 34. The rod 35 is also shown fragmented in FIGS. 2 and 3, and a chain-dotted line 36 indicates the continuation of said rod 35 in proximity of the pressure plate 15. A distance sleeve 37 which carries stops 38 and 39 at its respective ends is mounted on the actuating rod 35. The distance sleeve 37 extends through an appropriately wide bore of the pressure plate 15, so that the plate 15 can normally slide freely over the sleeve 37 without entraining the sleeve. Entrainment occurs only when the pressure plate 15 is moved by the linkage 16 and strikes one of the stops 38 or 39. In this way the actuating rod 35 is entrained in one or the other direction to pivot the blade 34 and open or close the shears 33.

As illustrated in FIGS. 2 and 3, the clamp sleeve 21 with the clamp head 25 is located nearer to the winding flyer 7, and the clamp sleeve 19 with the clamp head 24 is located nearer to the mandrel 6 and to the ball 5 wound thereon. The yarn 4 travelling from the winding flyer 7 to the ball 5 therefore arrives first in the path of the clamp sleeve 19 and then in the path of the clamp sleeve 21. As FIG. 4 clearly shows, the shears 33 are fixed to the oblique surface 31 of the guide means 18 approximately in the centre of the section of yarn running between the clamp sleeves 19 and 21 or the clamp heads 24 and 25 and can sever the yarn between the heads 24 and 25. The spring 26 is made weaker than the spring 27. The arrow F in FIG. 4 indicates the direction of rotation of the winding flyer 7. The clamp sleeves 19 and 21 and the respectively associated clamp heads 24 and 25 constitute two thread clamps arranged to clamp the yarn firmly when it has to be severed.

The device described operates in the following manner. When a ball 5 has been wound by the co-operation of the winding flyer 7 rotating in the direction of the arrow F with the rotating winding mandrel 6, the winding flyer 7 comes to rest approximately in the position shown in FIG. 4, with the yarn 4 having the path shown by chain-dotted lines. During the winding operation the clamp sleeves 19 and 21 with their clamp heads 24 and 25 are retracted by the linkage 16 into their extreme left-hand position with reference to FIGS. 2 and 3, so that they do not obstruct the winding operation. After completion of the winding operation the winding flyer 7 is stationary, the linkage 16 is pivoted to slide the pressure plate 15 and the guide sleeves 13 and 14 attached to it towards the right-hand side of FIG. 2 until the stops 28 and 29 on the clamp sleeves 19 and 21, which sleeves are initially maintained spaced from the guide sleeves 13 and 14 by the compression springs 26 and 27, abut against the guide means 18 and thereby reach their limiting position. Upon further forward sliding of the guide sleeves 13 and 14, the guide rods 22 and 23 slide in the clamp sleeves 19 and 21 so that the clamp heads 24 and 25 become separated from the clamp sleeves in the way shown in FIG. 2. Now, by briefly switching on the associated drive motor, the winding flyer 7 is caused to execute a rotation in the direction of the arrow F once more, which carries the yarn 4 on to the guide rods 22 and 23 between the clamp sleeves 19 and 21 and the clamp heads 24 and 25. This situation is illustrated in FIGS. 2 and 4.

During the said forward sliding of the pressure plate 15 the plate strikes the stop 39 of the distance sleeve 37 which is firmly attached to the actuating rod 35, so that the rod 35 slides forwardly. This causes the blade 34 of the shears 33, which is otherwise mounted stationary on the surface 31, to open.

The linkage 16 is now rocked backwards in the direction of the arrow B shown in FIG. 3. Initially the clamp heads 24 and 25 approach the associated clamp sleeves 19 and 21 and clamp the yarn 4 resting upon the guide rods 22 and 23 between the mutually opposed end faces of the sleeves and heads. Upon further retraction of the guide sleeves 13, 14 the clamp sleeves 19 and 21, which are urged towards the clamp heads 24 and 25 by the springs 26 and 27, are also entrained, so that the section of yarn running between the clamp heads 24, 25 enters the region of operation of the open shears 33. Simultaneously or just afterwards the pressure plate 15 strikes the stop 38 of the distance piece 37 attached to the actuating linkage 35 of the shears, and the shears 33 close and sever the yarn 4 between the clamp heads 24 and 25. This situation is illustrated in FIG. 3.

Because the helical spring 26 which determines the clamping pressure between the clamp sleeve 19 and the clamp head 24 is weaker than the spring 27, the yarn 4 is held less firmly in the upper thread clamp constituted by the clamp sleeve 7 and clamp head 24, than in the lower thread clamp adjacent to the winding flyer 7 and constituted by the clamp sleeve 21 and clamp head 25. The spring 26 is only sufficiently strong for the severed yarn end leading towards the ball 5 to be just retained between sleeve 19 and head 24. A recoil of the yarn 4 towards the ball 5 after the severing of the yarn is avoided by this means. There is therefore no long thread start hanging from the finished ball. Due to the light clamping operation between sleeve 19 and head 24, the yarn can moreover be detached easily from the thread clamp both when inserting a band on the ball 5 and also when automatically or manually removing the ball from the winding mandrel 6. The clamping achieved by the sleeve 21 and the head 25 is sufficiently strong, by an appropriate choice of the spring 27, to ensure that at the commencement of winding the next ball the yarn is drawn out from the thread clamp constituted by the sleeve 21 and the head 25 only after a plurality of revolutions of the mandrel 6. By this means a correct commencement of winding of the next ball is ensured and the yarn end is located in the interior of the ball and does not hang out of the finished ball.

It is thus desirable in the cutting device according to the invention that the two severed yarn ends are initially maintained in a definite manner, with different forces, so that the finished ball can easily be removed from the winding mandrel with a correctly coherent thread start, and a new ball can be wound with a regularly fed yarn start.

Figure 5:
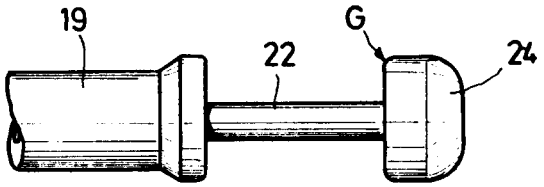
FIG. 5 is a side elevation of a thread clamp.

As will be clear from FIG. 5, the outer edge of the end face of the clamp head 24 confronting the clamp sleeve 19 is rounded all round as indicated by the arrow G. By this means any jamming or damage and accumulation of residual fibres during the extraction of the yarn from the thread clamp is prevented. For the same purpose, the edge of the free end face on the clamp sleeve 19 may also be correspondingly rounded if necessary. The same also applies to the clamp constituted by the clamp sleeve 21 and the clamp head 25.

I claim:

1. A device for cutting yarn on a ball winding machine with at least one winding station, each winding station comprising a winding flyer, a winding mandrel and a cutting device, the cutting device comprising two thread clamps, one of the thread clamps being located nearer to the winding flyer with the other of the thread clamps located nearer the winding mandrel, the clamp nearer the winding flyer having a higher clamping force for the yarn than the thread clamp nearer the winding mandrel; a cutting element; and first means for successively (a) interposing the thread clamps between the flyer and the mandrel, (b) activating the thread clamps to clamp yarn travelling from the flyer to the mandrel, and (c) feeding the yarn clamped between the clamps to the cutting element so that the yarn is severed between the clamps and the cut ends are held in the clamps.

2. A device according to claim 1, each thread clamp comprising a clamp head; a guide rod to carry said clamp head; and a clamp sleeve having an end face, said guide rod being slideably mounted in said clamp sleeve, said first means comprising second means for selectively effecting the movement of the clamp heads relative to the clamp sleeves in order to clamp yarn running on the guide rods between the clamp heads and the end faces of the clamp sleeves.

3. A device according to claim 2; further comprising a stationary guide to which the cutting element is mounted, the guide comprising third means for mounting the clamp sleeves for axial sliding movement relative to the cutting element.

4. A device according to claim 3 further comprising guide sleeves to which each guide rod is mounted, the stationary guide further comprising fourth means for mounting the guide sleeves for axial sliding movement relative to the cutting element, said first means further comprising a compression spring between the guide sleeve and the clamp sleeve associated with each guide rod, said springs urging the clamp sleeves toward the clamp heads to generate clamping forces between the end faces of the clamp sleeves and the clamp heads, the spring associated with the clamp nearer the winding flyer having a greater clamping force than the spring associated with the other clamp.

5. The device according to claim 4, the clamp sleeves further comprising stops to limit their travel toward said clamp heads under the forces exerted by said springs, said second means further selectively interposing exposed portions of said guide rods and clamp heads between the flyer and the mandrel, said second means and said springs effecting a two stage retraction of said thread clamps, the first retraction stage moving the clamp heads relative to the clamp sleeeves in order to clamp yarn running on the exposed guide rods between the clamp heads and the end faces of the clamp sleeves, the second retraction stage feeding the clamped yarn to the cutting element.

6. A device according to claim 1 wherein the cutting element is a shears with two blades which are movable relative to each other.

* * * * *